United States Patent [19]

Hemminger

[11] 4,015,388

[45] Apr. 5, 1977

[54] RETAINING CLIP FOR A DIVISION BAR

[75] Inventor: James W. Hemminger, Buchanan, Mich.

[73] Assignee: PPG Industries, Inc., Pittsburgh, Pa.

[22] Filed: Jan. 14, 1976

[21] Appl. No.: 649,119

[52] U.S. Cl. ..... 52/395; 52/403; 52/502

[51] Int. Cl.[2] ..... E04B 1/62

[58] Field of Search ..... 52/502, 397, 403, 466, 52/498, 400, 235, 741, 395

[56] References Cited

UNITED STATES PATENTS

| | | | |
|---|---|---|---|
| 2,866,527 | 12/1958 | Schilling | 52/235 X |
| 2,998,112 | 8/1961 | Burgin | 52/502 X |
| 3,435,579 | 4/1969 | Morgan, Jr. | 52/400 |
| 3,866,374 | 2/1975 | Dallen | 52/400 |

*Primary Examiner*—Price C. Faw, Jr.
*Assistant Examiner*—Carl D. Friedman
*Attorney, Agent, or Firm*—Donald Carl Lepiane

[57] ABSTRACT

A glazing division bar includes a facing member having a retaining clip secured therein and a gutter member. The retaining clip is secured in the facing member by opposed flexible legs of the retaining clip engaging an adjacent shoulder of a seal anchoring groove formed on the end of each side wall of the facing member. The retaining clip has a retaining groove formed by a bifurcated member disposed between the flexible legs for receiving arrow-shaped stem of the gutter member to secure the facing member to the gutter member about marginal edges of a glazed unit.

The glazing division bar is disassembled by inserting a flat blade between a seal anchoring groove of the facing member and adjacent marginal edge of the unit into engagement with a flexible leg of the retaining clip and urging the flexible leg away from the shoulder of the seal anchoring groove to release the facing member. Thereafter the retaining clip is removed from the stem of the gutter member to free the glazed unit.

26 Claims, 6 Drawing Figures

RETAINING CLIP FOR A DIVISION BAR

BACKGROUND OF THE INVENTION

1. Field of the Invention

This invention relates to a glazing division bar and more particularly, to a retaining clip for use in a glazing division bar.

2. Discussion of the Technical Problems

There are many known assemblies for retaining panels, e.g., glass sheets or multiple glazed units by grasping a marginal edge thereof and these are commonly referred to as division bars, glass division bars or glazing division bars. In general, the division bar includes a facing member secured to a gutter member about the marginal edge of the panel.

A division bar for panels is taught in U.S. Pat. No. 3,339,329 and various types of glazing division bars are taught in U.S. Pat. Nos. 2,845,154; 3,081,849; 3,081,850; 3,081,851; 3,381,434; 3,435,579; 3,488,828; 3,678,651; 3,722,161; and 3,805,470.

Preferably, the facing member of the division bar has a retaining clip that engages the gutter member to secure the facing member to the gutter member about the marginal edges of the panel. The division bars are arranged to form a curtain wall construction for retaining a plurality of panels in position. In the instance where the panels are glass sheets or multiple glazed units, the division bars are constructed so that the facing member is easily removed from the gutter member to replace damaged glass sheets or glazed units.

In U.S. Pat. No. 3,381,434 there is taught a division bar for glass sheets or glazed units. In general, an extruded gutter member includes a web terminating at each of the edges in a pair of outwardly seal anchoring grooves and a groove formed in a flange located intermediate the marginal edges. The flange has an offset to provide (1) a ledge for retaining a portion of a retaining clip therein and (2) a catch member on the other opposed side. The clip includes a central elongated portion having a pair of outwardly directed oppositely disposed tabs. The clip at one end of the elongated portion terminates in a U-shaped portion having an end engageable with the ledge of the flange, and a tab engageable with the catch member to retain the clip therein. An extruded facing member includes a web having a pair of marginal edges each having a seal anchoring groove and an intermediate flange insertable in the U-shaped portion of the clip. The intermediate flange has an abutment engageable with the other tab of the clip and a retaining flange to lock the clip in position. The facing member and gutter member are separated by inserting hooked end of a tool about the clip to disengage it from the retaining flange to release the tab from the abutment of the facing member.

Although this type of glazing system is acceptable for ease of replacing damaged glass, it has limitations. For example, when the facing member is removed, there are no facilities to retain the glass in position.

It would be advantageous therefore if a division bar for a curtain wall structure was available that did not have the drawbacks of the prior art.

SUMMARY OF THE INVENTION

This invention relates to a retaining clip for a division bar wherein the division bar is of the type having a gutter member and a facing member. The clip includes a base having a bifurcated member extending upward from a major surface of the base to form a retaining groove having opposed spaced tabs extending toward each other over the retaining groove for engaging a protruding portion of the gutter member. At least one flexible leg extends upward from the base in spaced relation to the bifurcated member. Facilities mounting at least the at least one flexible leg are provided for maintaining the clip in the facing member.

This invention also relates to a division bar for panels, e.g., glass sheets or multiple glazed units having a gutter member and a facing member. The gutter member having a base member having at least one side wall for engaging marginal edge portions of the panel and an elongated web extending outwardly therefrom. The web terminates in a generally arrowed shaped end. The facing member has a base having a pair of opposed sides extending therefrom. At least one of the pair of opposed side engages marginal edge portions of the panel. A retaining clip is detachably secured in the facing member between the opposed sides and has a bifurcated member forming a retaining groove for receiving the arrowed shaped web end and a tab extending from each of the bifurcated members over the groove for engaging the base of the arrowed shaped end to secure the facing member to the gutter member about the marginal edges of the panel.

Further this invention relates to a glazing system for a curtain wall construction using the division bar.

Still further, this invention relates to a method of glazing a fenestration using the division bar.

Also this invention relates to deglazing the fenestration. In general a blade is inserted between a facing member side portion and adjacent marginal edge portion of the panel into engagement with the flexible leg of the retaining clip. The leg of the clip is moved away from the side portion of the facing member to release the facing member. Thereafter the clip is removed to free the panel from the curtain wall.

DESCRIPTION OF THE INVENTION

This invention relates to a retaining clip for division bars used in the construction of the glazing system. As will become apparent the arrangement of the division bars to be discussed is not limiting to the invention and is presented for illustration purposes only.

Figure 1:
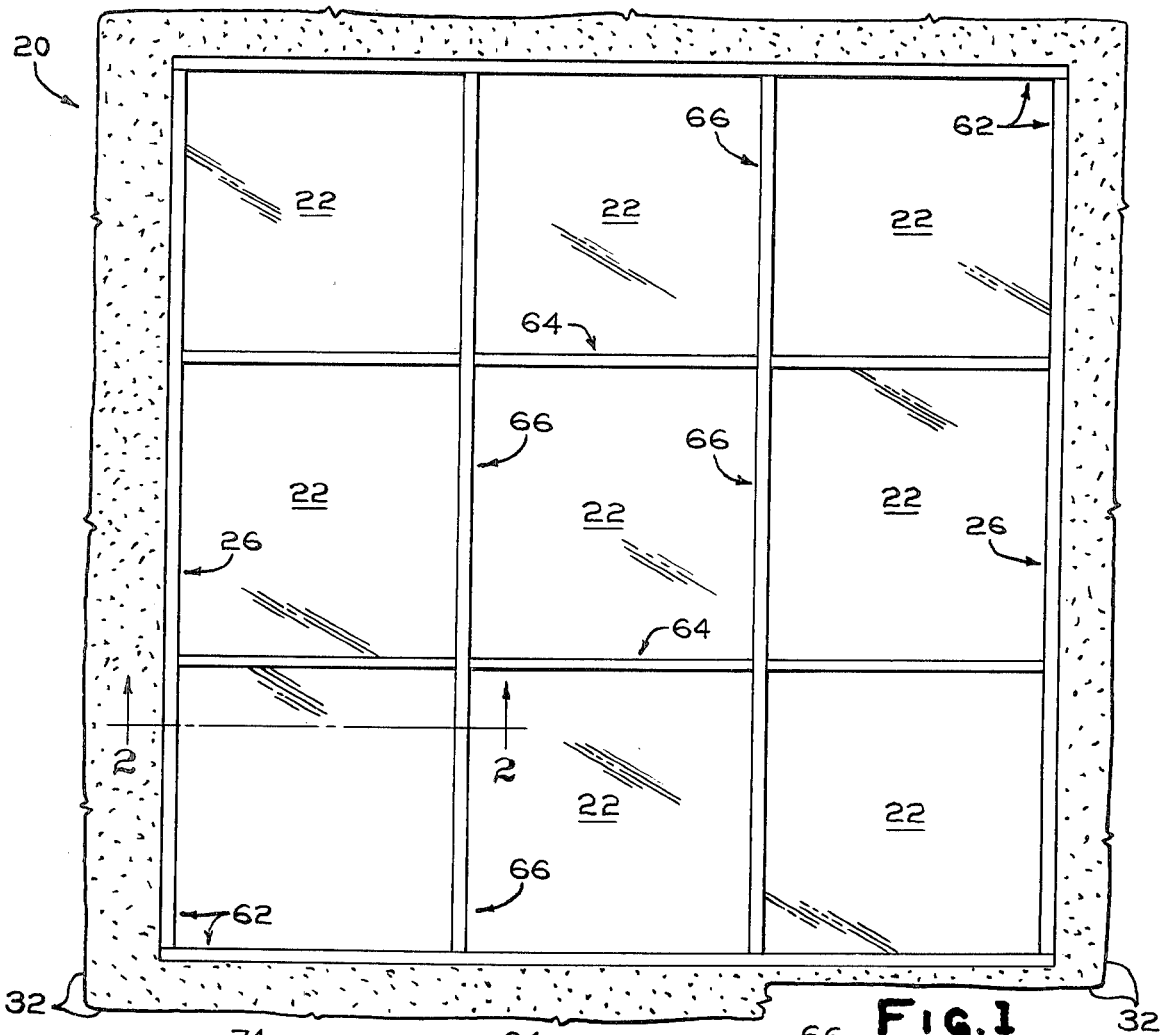
FIG. 1 is a frontal view of a store front glazing system incorporating features of the invention.
Figure 2:
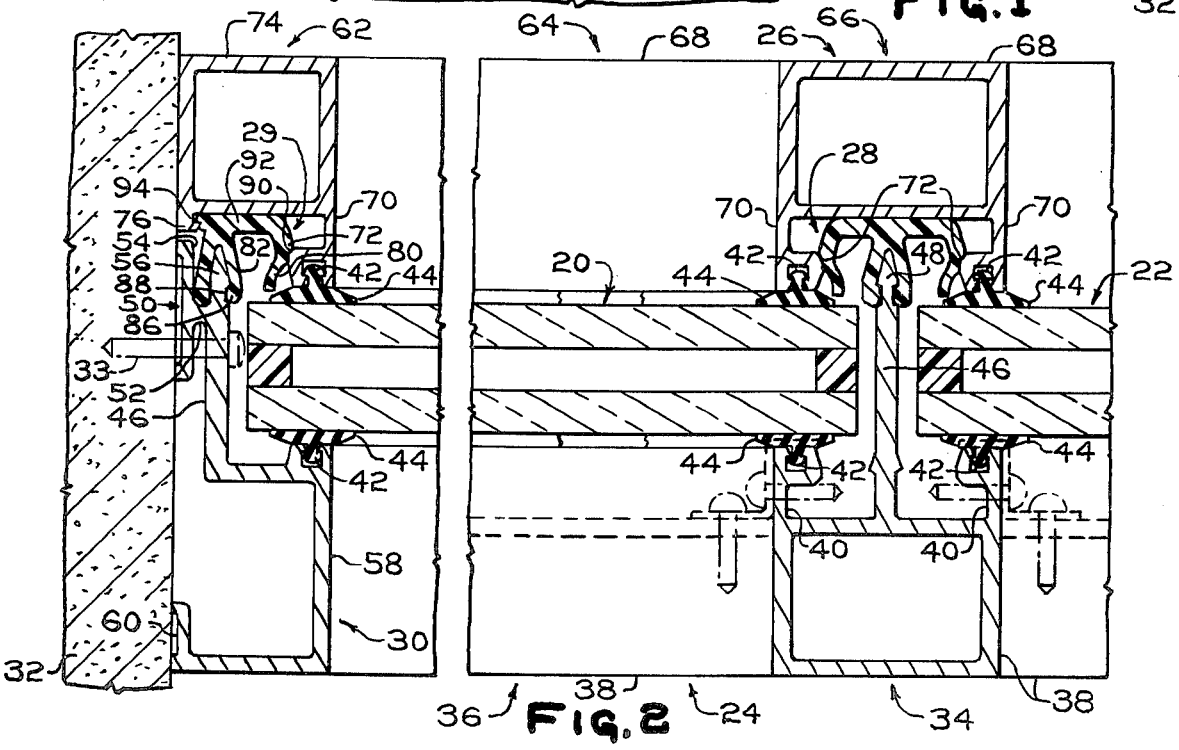
FIG. 2 is a view taken along lines 2—2 of FIG. 1.

In FIG. 1, there is shown a store front glazing system 20 incorporating features of the invention. The glazing system as shown in FIG. 2 includes a plurality of multiple glazed units 22 secured at their opposed marginal edges between a gutter system 24 and a facing system 26 by intermediate retaining clips 28 and perimeter retaining clips 29 incorporating features of the invention.

The gutter system 24 includes perimeter gutter members 30 secured to the walls 32 of the wall opening or fenestration by way of screws 33 of the type used in the art, vertical intermediate gutter members 34 secured at their ends to opposed perimeter gutter members and horizontal intermediate gutter members 36 secured at their ends between the perimeter gutter members and/or the vertical intermediate gutter members 34 in any conventional manner.

The gutter members 30, 34 and 36 are preferably made of extruded metal, e.g., aluminum. The intermediate vertical and horizontal gutter members are identical in construction and include a base member 38 having a pair of opposed side walls 40 terminating in a seal retaining groove 42 for capturing weather stripping 44 of the type used in the art.

A web or stem 46 extends upward from the base 38 between and beyond the side walls 40 and glazed units 22 and terminates in an arrowed shaped head 48. The arrowed shaped head is engaged by the retaining clip 28 in a manner to be discussed below.

The perimeter gutter member 30 is similar in construction in that it includes the seal retaining groove 42 for the weather stripping 44 and the web 46. In other respects the perimeter gutter member 30 is modified by providing a wall engaging portion 50 connected to the web 46 by way of leg member 52 to form a receiving groove 54 therebetween. The end of the web 46 of the perimeter gutter member 30 terminates in a semi-arrowed head 56 so that the receiving groove 54 has flat walls to facilitate removal of the perimeter clip 29 in a manner to be discussed below. Base 58 of the perimeter gutter member 30 has a second wall engaging portion 60 lying in the same plane as the first wall engaging portion 50 as shown in FIG. 2.

The facing system 26 includes perimeter facing member 62, intermediate horizontal facing members 64 and intermediate vertical facing members 66 made of extruded metal, e.g., aluminum. The intermediate horizontal and vertical facing member 64 and 66, respectively, are identical in construction and include a base 68 having a pair of opposed side walls 70 each terminating in the seal retaining groove 42 for the weather stripping 44. Shoulder 72 of outer wall of the seal retaining groove extends toward each other over the base as shown in FIG. 2 to detachably secure the retaining clip 28 in a manner to be discussed below.

The perimeter facing member 62 has a base 74 similar in configuration to the base 68 of the intermediate facing members 64 and 66 but smaller in size, the side wall 70 terminating in the seal retaining groove 42 and the shoulder 72 extending over the base 74. Opposite to the side wall 70 of the perimeter facing member 62 and integral with the base 74 is an inwardly extending ledge 76. The shoulder 72 of the seal retaining groove and ledge 76 detachably secure the perimeter retaining clip 29 in the perimeter facing member 62 in a manner to be discussed below.

Figure 3:
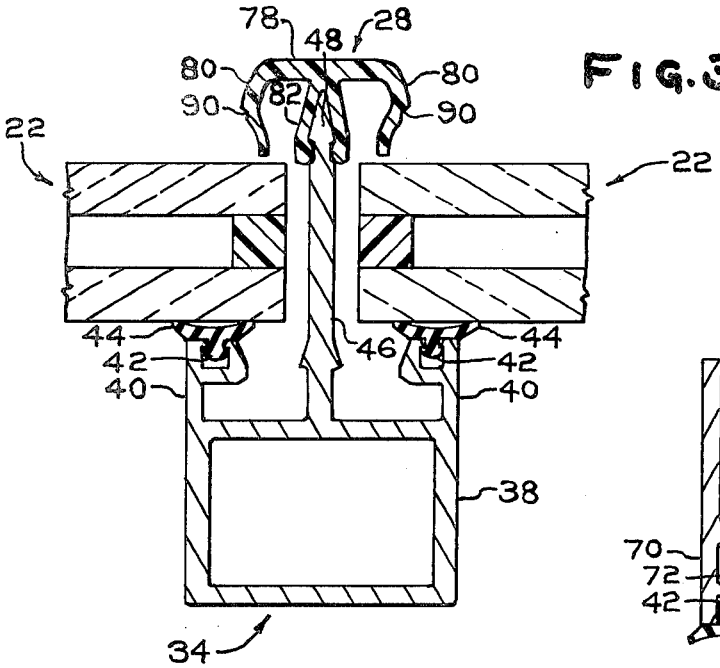
FIG. 3 is a cross-sectional view having portions removed for purposes of clarity illustrating the retaining clip of the invention retaining two glazed units in position prior to applying a facing member incorporating features of the invention.
Figure 4:
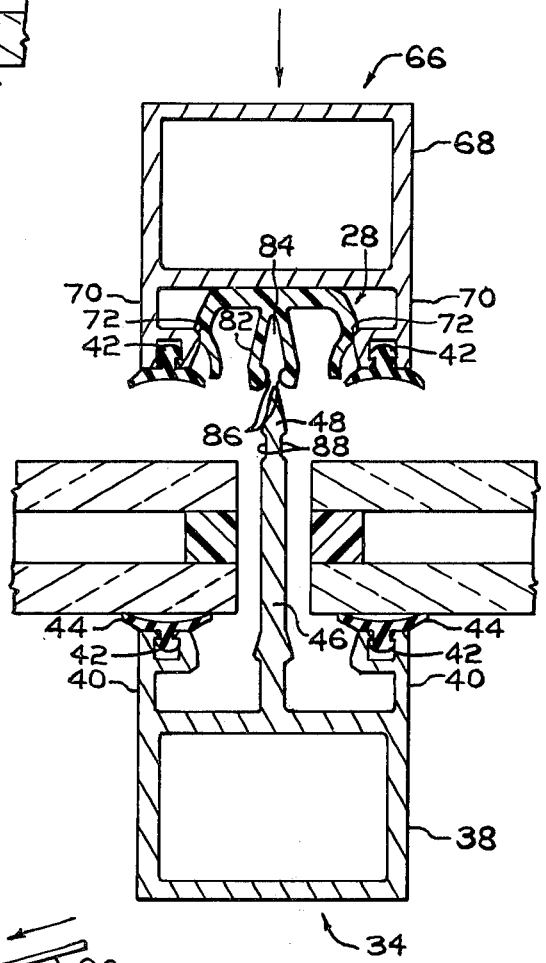
FIG. 4 is a view similar to FIG. 3 showing facing member incorporating features of the invention being secured to a gutter member about the marginal edges of adjacent glazed units.

With reference to FIGS. 3 and 4, the intermediate retaining clip 28, in general, includes a base 78 having a pair of serpentine shaped outer legs 80 extending therefrom and a bifurcated member 82 forming a groove 84 (shown better in FIG. 4) shaped to receive the arrowed shaped head 48 of the web 46 of the intermediate gutter members 34 and 36. A pair of tabs 86 extending from the bifurcated member 82 over the groove 84 are receivable in recesses 88 formed below the arrowed shaped head 48 to secure the clip 28 on the gutter members 34 and 36.

Figure 5:
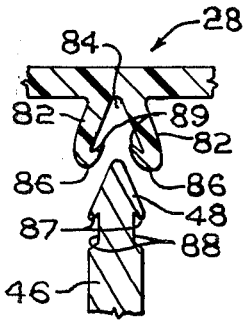
FIG. 5 is an exploded view of the retaining clip of the invention and web of gutter member having portions removed for purposes of clarity.

Referring now to FIG. 5, the base of the arrowed shaped head 48 has inwardly sloping walls 87 which, if extended, intersect within the arrowed shaped head 48. The tabs 86 of the clip 28 have corresponding sloping walls 89. In this manner, as the facing members 66 and clips 28 are urged away from the gutter member 34, the bifurcated legs 82 are urged against the web 46 to prevent the clip from disengaging the web 46.

As shown in FIG. 3, the outer legs 80 of the clip 28 each have a notch 90 that engages adjacent shoulders 72 of the seal retaining groove 42 to retain the clip 28 in the intermediate facing members 66 between the side walls 70 as shown in FIG. 4.

Referring back to FIG. 2, the perimeter retaining clip 29 is similar in construction to the intermediate retaining clip 28 except that the base has only one flexible leg 80 and the bifurcated member 82 attached to base 92. The perimeter retaining clip 29 is retained in the perimeter facing members 62 by the ledge 76 engaging slot 94 formed on the base 92 of the clip 29 adjacent the bifurcated member 82 and the groove 90 of the leg 80 engaging the shoulder 72 of the seal retaining groove 42 as shown in FIG. 2.

Figure 6:
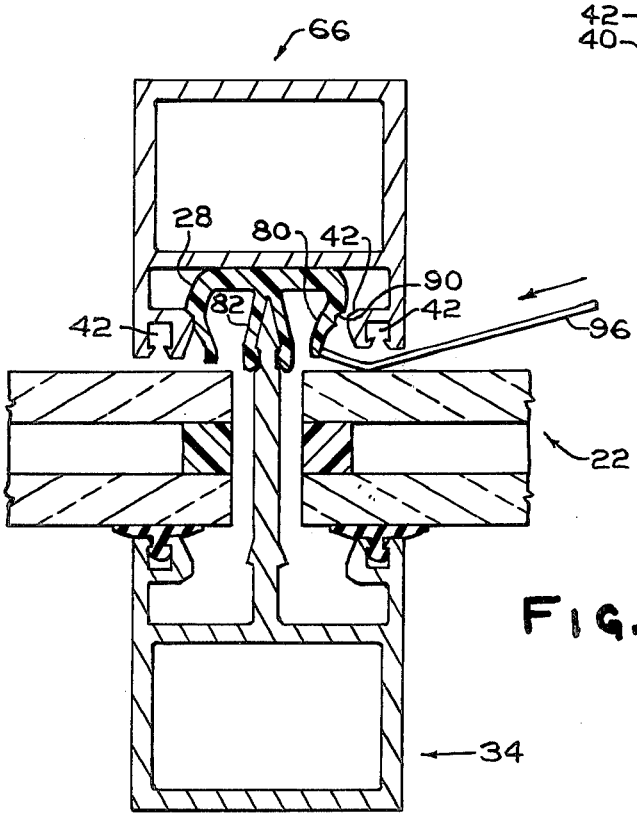
FIG. 6 is an illustration showing the removing of the facing member of FIG. 4 in accordance to the teachings of the invention.

The length of the retaining clip is not limiting to the invention, however, clips having a length of about three-fourths inch (1.90 centimeters) are normally used. The retaining clip of the instant invention facilitates replacement of panels, e.g., glass sheets or multiple glazed units in a glazing system. With reference to FIG. 6, the intermediate facing members 34 are removed by removing the weather stripping 44 from the facing member 66 in any conventional manner. Thereafter a thin rigid blade member 96 is inserted between a glazing unit 22 and the seal retaining groove 42 of the facing member 66 into engagement with an outer leg 80 of the retaining clip 28. The outer leg is urged toward the bifurcated member 82 to disengage the leg 82 from the shoulder 72 of the seal retaining groove 42. In this manner, the facing member 66 is free of the retaining clip and is removed. The multiple glazed units 22 are held in position by the outer legs 80 until the facing member 66 is removed to expose the marginal edges of the unit 22. Thereafter, the retaining clips are removed by urging a tab 86 of the bifurcated member out of its respective recess 88 in the web 46 to remove the panel 22.

With reference to FIG. 2, the perimeter facing member 62 is removed in a similar manner as the intermediate facing members 64 and 66. The perimeter retaining clip 29 is removed from the web 46 of the gutter member 30 as the intermediate clip was removed from the web 46 of the intermediate gutter members 34 and 36. It should be noted that the web 46 of the perimeter gutter member 30 has a semi-arrowed shaped end 56 so that the bifurcated member easily slides out of the receiving groove 54 when the tab of the bifurcated member disengages the recess 88 below the end 56 of the web 44.

The retaining clip of the invention can also be used as to hold the panels in position before applying the facing members. For example, the panels are mounted in the opening formed by the gutter members and a clip mounted on the web 46 of the gutter members as shown in FIG. 3. The legs 80 of the clip engage the marginal edge portions of the panel holding them in position. Thereafter the clips are removed as previously discussed and the facing members mounted on the gutter member.

The retaining clip can be made of any flexible material, e.g., metal or plastic but is preferably made of plastic. A plastic retaining clip provides insulation between the facing member and the gutter member to reduce heat losses and prevent condensation of the panels.

The retaining clips of the invention are reuseable because they are not destroyed when removing the facing members or the panels.

An additional feature of the invention in the prevention of water dripping over the panels. For example, the web 46 of the horizontal gutter member extends over the panels. Moisture that passes the weather stripping flows along the web of the horizontal gutter and down the vertical gutter preventing moisture from running down the face of the panels.

DETAILED DESCRIPTION OF THE INVENTION

The invention is used to glaze a store front with nine (9) 1 inch thick glazed units of the type taught in U.S. Pat. No. 3,733,237. The store front has a rectangular fenestration bound by walls 32 and having dimensions of 12¼ feet (3.8 meters) × 11-5/16 feet (3.4 meters).

With reference to FIG. 2, gutter system 24 includes perimeter gutter member 30, intermediate vertical and horizontal gutter members 34 and 36, respectively, each made of 1/16 inch (0.16 centimeter) thick extruded aluminum. The intermediate vertical and horizontal gutter members 34 and 36 each include a cross section rectangular shaped base 38, 1 inch (2.54 centimeters) by 1¾ inch (4.44 centimeters). A pair of opposed side walls 40 extend from the base 38 and terminate in a seal retaining groove 42 for receiving weather stripping 44 of the type used in the art.

The distance from the top of the seal retaining groove 42 to the base 38 is three-fourths inch (1.92 centimeters). A web 46 extends upward from the bar 38 between the side walls for a distance of 1.6 inches (4.1 centimeters) beyond the side walls 40. The web 46 has an arrowed shaped end 48 that is 0.188 inch (0.47 centimeter) as its widest point and 0.306 inch (0.75 centimeter) long. The portion of the web 46 below the arrowed shaped end has 7° sloping walls 87 and recesses 88 shown better in FIGS. 4 and 5.

The perimeter gutter members 30 have a base of a generally cross sectional open sided configuration. The base has a seal retaining groove 42 for retaining the weather stripping 44 therein. The length of the base and seal retaining groove is 1¾ inches (4.4 centimeters). The bottom leg of the base 58 as viewed in FIG. 2 in 1.187 inches (3 centimeters) and terminates in a wall engaging portion 60. A web 46 is connected to the upper leg of the base 58 as shown in FIG. 2 and extends 1.6 inches (4.1 centimeters) beyond the seal engaging groove 42. The web 46 of the perimeter gutter member terminates in a semi-arrowed head 56 having a flat side adjacent receiving groove 54 formed by wall engaging portion 50, leg 52 and the web 46 as shown in FIG. 2. The receiving groove 54 is ¼ inch (0.64 centimeter) wide, and ⅜ inch (0.96 centimeter) deep. The wall engaging portion 50 and 60 lie in the same plane.

The perimeter gutter 30 is secured to the walls of the fenestration by screws 33 of the type used in the art passing through the web 46 and the wall engaging portion 50. A pair of vertical gutter members 34 are secured between the upper and lower gutter member as viewed in FIG. 1 in any conventional manner and horizontal gutter members 36 are mounted between the perimeter gutter member and on vertical gutter member in any conventional manner to provide openings of 3 feet (0.9 meter) by 3 feet (0.9 meter) as measured between opposed webs 46 of the gutter members.

A rubber strip (not shown) is placed on the upper surface of the web 46 of the horizontal perimeter and intermediate horizontal gutter member as viewed in FIG. 1 to provide thermal insulation between the glazed units and the web 46 and to prevent damage to the corners of the glazed unit.

A multiple glazed unit 2 feet 11½ inches (0.8 meter) × 2 feet 11½ inches (0.8 meter) is placed in the upper left hand corner opening and held therein by perimeter retaining clip 29, a glazed unit is placed in the opening directly below and held therein by perimeter clips 29 and intermediate retaining clips 28, and a glazed unit is positioned in the bottom left opening and held therein by perimeter retaining clip 29 and intermediate retaining clip 28. The clips are spaced about 16–18 inches (0.4–0.45 meters).

With reference to FIG. 3, the intermediate retaining clip 28 is made of acetal resin of the type sold by Celanese Corporation under the trademark CELCON M-90 W/UV. The intermediate retaining clip includes a base 78, 0.150 inch (0.38 centimeter) thick; ⅞ inch (0.2 centimeter) wide and ¾ inch (0.39 centimeter) long. Outer legs 80 extend outward from the base 78 for a length of 0.287 inch (0.72 centimeter) then curve inward about a 0.638 inch (1.6 centimeter) radius for a length of 0.547 inch (1.4 centimeters) and then curve outward about a 0.160 inch (0.4 centimeter) radius for a length of 0.610 inch (1.6 centimeters). The height of the legs from the base is .460 inch (1.7 centimeter).

A notch 90 is provided in the outer surface of the legs 80 which engages the shoulder 72 of the seal retaining groove to retain the clip in the intermediate facing member as shown in FIG. 4.

A bifurcated member 82 extends 0.656 inch (1.7 centimeters) from the base 78 to form an arrowed shaped groove 84 for receiving the arrow shaped head 48 of the web 46 of the intermediate gutter members 34 or 36 (see FIG. 5). The walls of the bifurcated member 82 are 0.1088 inch (0.25 centimeter) thick, and have tabs 86 extending over the groove and have sloping walls 89 (see FIG. 5) corresponding to the sloping walls 87 of the web 46 of the gutter member. The base is set in recess 88 on the web 46 to secure the retaining clip on the web 46 as shown in FIG. 3. Generally, the intermediate retaining clip is inserted on the web 46 to retain adjacent units in their opening. For example, legs 80 engage marginal edges of the units as shown in FIG. 3.

The perimeter retaining clip 29 is similar in construction to the intermediate clip 29 but has only one leg 90 as shown in FIG. 2. The base 92 is three-fourths inch (1.92 centimeters) wide and has a slot 94 provided on the side of the base 92 that is engaged by ledge 76 of the perimeter retaining clip 29.

The retaining clip 90 on the leg 80 engages the shoulder 12 of the seal retaining groove 42 and the slot 94 in the base is engaged by the ledge 76 of the perimeter facing member to retain the perimeter retaining clip in the perimeter facing member 62. The leg 80 of the perimeter retaining clip engages the marginal edges of the glazed unit to prevent it from falling out of the unit.

The intermediate retaining clips 28 are removed from the left upper intermediate horizontal gutter member 36 as viewed in FIG. 1 by urging a side of the bifurcated member 82 away from the arrow headed end 48.

As shown in FIG. 4, an intermediate facing member having the retaining clip 29 therein is secured on the gutter member by the groove 84 of the bifurcated member 82 receiving the arrow head 48 and the tabs 86 of the bifurcated member seating in recesses 88.

The intermediate horizontal facing member 64 similar to the intermediate horizontal vertical facing member 66 is of the same dimension as the intermediate gutter member 34 except that the intermediate facing member has no web 46 so as to receive the retaining clip. The retaining clips 29 are spaced about 16–18 inches (0.4 – 0.45 meters) apart.

After the intermediate horizontal facing member 64 is secured in position on the upper left intermediate horizontal gutter member, an intermediate horizontal facing member is provided on the lower left intermediate horizontal member as viewed in FIG. 1.

The perimeter retaining clips 29 are removed from the left vertical perimeter gutter member 30 and a perimeter facing member having perimeter retaining clips 29 is secured thereto. The outer dimensions of the perimeter facing members 62 are similar to the perimeter gutter member 30.

The remaining openings in the glazing system 20 are provided with a glazed unit 22 in a similar manner.

As can now be appreciated, the invention is not limited to the sequence in which a multiple glazed unit is positioned and held in an opening of the glazed system.

With reference to FIG. 6, a damaged glazed unit is removed in the following manner. The weather stripping is removed from the facing member 66 and a 45° beveled thin rigid member 96 between the weather stripping 44 of the facing member 66 and the glazed unit 22 to engage the leg 80 of the retaining clip 28. Urging the blade inward disengages the notch 90 of the clip from the shoulder 72 of the seal retaining groove to release the facing member.

The retaining clips are removed and a new glazed unit is installed as previously discussed.

As can be appreciated the invention is not limited to the example which is presented for illustration purposes only.

What is claimed is:

1. A retaining clip for a division bar wherein the division bar is of the type having a gutter member and a facing member, comprising:

a base having a major surface;

a bifurcated member attached to and extending away from said major surface of said base for engaging the gutter member;

at least one flexible leg attached to and extending away from said major surface of said base in spaced relation to said bifurcated member; and means formed on at least said at least one flexible leg for maintaining the clip in the facing member.

2. The retaining clip as set forth in claim 1 wherein said maintaining means includes a notch on the outer surface of said at least one flexible leg and a slot formed in a side portion of said base for engaging opposed side portions of the facing member.

3. The retaining clip as set forth in claim 1 wherein a pair of flexible legs extend away from said base, one on each side of said bifurcated member and said maintaining means includes a notch on the outer surface of each of said flexible legs.

4. The retaining clip as set forth in claim 1 wherein the clip is made of plastic.

5. The retaining clip as set forth in claim 1 wherein the clip is made of metal.

6. The retaining clip as set forth in claim 1 wherein said tabs of said retaining clip having sloping wall portions.

7. The retaining clip as set forth in claim 1 wherein said bifurcated member further includes opposed spaced tabs extending toward each other over the groove.

8. A division bar for a panel comprising:

a gutter member comprising a base member having at least one side wall extending away from said base member for engaging marginal edge portions of the panel and a web extending away from said base member in spaced relation to said at least one side wall;

a facing member comprising a base member having a pair of opposed sides extending from said base member of said facing member, at least one of said pair of opposed sides for engaging marginal edge portions of the panel; and a retaining clip mounted in said facing member and comprising:

a base having a major surface;

a bifurcated member attached to and extending away from said major surface of said base, said bifurcated member engaging said web to secure said facing member to said gutter member about opposed marginal edges of the panel;

at least one flexible leg attached to and extending away from the major surface of said base in spaced relation to said bifurcated member; and means formed on at least said at least one flexible leg for engaging said at least one of said pair of opposed sides of said facing member for maintaining said clip in said facing member.

9. The division bar as set forth in claim 8 wherein said web of said gutter member terminates in an arrowed shaped end and said bifurcated member further includes opposed spaced tabs extending toward each other over the groove for receiving and engaging said arrowed shaped end of said web.

10. The division bar as set forth in claim 9 wherein the base of said arrowed shaped end of said web has sloping walls and said tabs of said bifurcated member has corresponding sloping walls.

11. The division bar as set forth in claim 8 wherein said gutter member further includes at least one side member extending from said base member of said gutter member in spaced relation to said web and terminating in a seal retaining groove.

12. The division bar as set forth in claim 11 wherein one of said pair of opposed sides of said facing member terminates in a seal retaining groove and the other side has an inwardly extending ledge; and said retaining clip includes a slot formed in a side of said base opposite said at least one flexible leg and engageable with said ledge, and said flexible leg having a notch on the outer surface engageable with shoulder of said seal retaining groove of said facing member to secure said retaining clip in said facing member.

13. The division bar as set forth in claim 11 wherein each of said pair of opposed sides of said facing member terminates in a seal retaining groove; and said retaining clip includes a pair of flexible legs attached to said base about said bifurcated member, each of said legs having a notch on the outer surface engageable with shoulder of adjacent one of said seal retaining groove of said facing member to secure said retaining clip in said facing member.

14. The division bar as set forth in claim 8 wherein said clip is made of plastic.

15. The division bar as set forth in claim 8 wherein said clip is made of metal.

16. A glazing system comprising:

an opening defined by gutter members, each gutter member comprising a base member having a web extending outwardly therefrom to define a ledge about the opening, said web terminating in a generally arrowed shaped end;

a panel mounted in the opening supported by the ledge of said gutter members with the arrowed shaped end of said gutter member extending beyond said panel; and facing members secured to said gutter members about the marginal edges of said panel to retain said panel in position, said facing members comprising:

a base member;

a pair of opposed sides extending from said base member of said facing members; and at least one retaining clip mounted in said facing members between said pair of opposed sides and comprising:

a base having a major surface;

a bifurcated member attached to and extending away from said major surface of said base, said bifurcated member having a groove for receiving said arrowed shaped end of said web and opposed spaced tabs extending toward each other over the groove for engaging the base of said arrowed shaped end;

at least one flexible leg attached to said base and extending away from the major surface of said base in spaced relation to said bifurcated member; and means formed on at least said at least one flexible leg for engaging said at least one of said pair of opposed sides of said facing members for maintaining said clip in the facing member.

17. The glazing system as set forth in claim 16 wherein the base of said arrowed shaped end of said web has sloping walls and said tabs of said bifurcated member has corresponding sloping walls.

18. The glazing system as set forth in claim 16 wherein said gutter members are perimeter gutter members secured to walls of a structure and a side portion extends from said base member of said gutter member in spaced relation to said web and terminates in a seal retaining groove;

said facing member includes one side terminating in a seal retaining groove and the other side having an inwardly extending ledge;

weather stripping means mounted in said seal retaining groove of said gutter member and said face member and engaging adjacent marginal edges of said panel; and said retaining clip includes a slot formed in the a side of said base opposite said at least one flexible leg and engageable with said ledge of said facing member, and said flexible leg having a notch on the outer surface engageable with shoulder of said seal retaining groove of said facing member to secure said retaining clip in said facing member.

19. The glazing system as set forth in claim 16 wherein said gutter members include intermediate gutter members having a pair of side members extending from said base member of said gutter member in spaced relation to one another and each terminating in a seal engaging groove; and weather stripping means mounted in each of said seal retaining grooves and engaging adjacent marginal edges of said panel.

20. The glazing system as set forth in claim 19 wherein sections of said facing members are intermediate facing members and each of said pair of opposed legs terminate in a seal retaining groove;

weather stripping means mounted in each of said seal retaining grooves and engaging adjacent marginal edges of the panel; and said retaining clip includes a pair of flexible legs connected to said base about said bifurcated member, each of said legs having a notch on the outer surface engageable with shoulder of adjacent one of said seal retaining grooves of said face member to secure said retaining clip in said facing member.

21. The glazing system as set forth in claim 16 wherein the clip is made of plastic.

22. The glazing system as set forth in claim 16 wherein the clip is made of metal.

23. The glazing system as set forth in claim 16 wherein said panel is a spandrel unit.

24. The glazing system as set forth in claim 16 wherein said panel is a glass sheet.

25. The glazing system as set forth in claim 16 wherein said panel is a multiple glazed unit.

26. A method of deglazing a fenestration comprising:

removing at least one weather stripping from seal retaining groove of facing member;

inserting a knife edge between the seal retaining groove of the facing member and panel into engagement with flexible leg of retaining clip secured in the facing member;

urging the leg inward out of engagement with the facing member to release the facing member; and removing the clip from gutter member.

* * * * *

UNITED STATES PATENT AND TRADEMARK OFFICE

CERTIFICATE OF CORRECTION

PATENT NO. : 4,015,388

DATED : April 5, 1977

INVENTOR(S) : James W. Hemminger

It is certified that error appears in the above-identified patent and that said Letters Patent are hereby corrected as shown below:

Column 8, Claim 6, line 13, delete "having" and insert --have--.

Column 9, line 51, Claim 16, delete "members" and insert --member--.

Column 10, Claim 18, line 11, delete "the".

Signed and Sealed this

Seventh Day of June 1977

[SEAL]

*Attest:*

RUTH C. MASON
*Attesting Officer*

C. MARSHALL DANN
*Commissioner of Patents and Trademarks*